United States Patent [19]

Tsubokawa

[11] Patent Number: 4,619,023

[45] Date of Patent: Oct. 28, 1986

[54] SLIDE FASTENER

[75] Inventor: Yoshitoki Tsubokawa, Kurobe, Japan

[73] Assignee: Yoshida Kogyo K. K., Tokyo, Japan

[21] Appl. No.: 712,153

[22] Filed: Mar. 15, 1985

[30] Foreign Application Priority Data

Mar. 28, 1984 [JP] Japan ..... 59-45465[U]

[51] Int. Cl.[4] ..... A44B 19/40

[52] U.S. Cl. ..... 24/394; 24/381; 24/403

[58] Field of Search ..... 24/394, 395, 397, 398, 24/403, 426, 430, 381

[56] References Cited

U.S. PATENT DOCUMENTS

| | | | |
|---|---|---|---|
| 3,783,476 | 1/1974 | Fröhlich | 24/394 |
| 3,785,014 | 1/1974 | Canepa | 24/381 |
| 3,795,950 | 3/1974 | Sohr | 24/395 |
| 3,831,227 | 8/1974 | Beitter | 24/394 |
| 3,922,761 | 12/1975 | Schwendt | 24/394 |
| 3,946,465 | 3/1976 | Moertel | 24/394 |
| 4,319,387 | 3/1982 | Yoshida | 24/394 |
| 4,321,733 | 3/1982 | Yoshida | 24/395 |

FOREIGN PATENT DOCUMENTS

| | | | |
|---|---|---|---|
| 1122214 | 9/1956 | France | 24/381 |
| 600006 | 3/1948 | United Kingdom | 24/381 |
| 696722 | 9/1953 | United Kingdom | 24/381 |
| 2044841 | 10/1980 | United Kingdom | 24/403 |

*Primary Examiner*—Victor N. Sakran

*Attorney, Agent, or Firm*—Hill, Van Santen, Steadman & Simpson

[57] ABSTRACT

A slide fastener includes a row of coupling elements secured by sewing stitches to one longitudinal edge of a support tape made of a fabric material free of threads woven or knitted together. The sewing stitches are formed of at least one thread having loops passing through the support tape. The thread is made of a monofilamentary material which is free from thermal deformation. The slide fastener can retain, after heat-set treatment, sufficient mechanical strength at the connection between the sewing stitches and the row of coupling elements.

3 Claims, 6 Drawing Figures

SLIDE FASTENER

BACKGROUND OF THE INVENTION

1. Field of the Invention

This invention relates to slide fasteners and has particular reference to a slide fastener having a support tape made of a fabric material free of threads woven or knitted.

2. Prior Art

There are known slide fasteners which comprise a support tape carrying along its one longitudinal edge a row of coupling elements, the support tape being made of a film of synthetic resin, a non-woven fabric or a thread-free material similar to a material used for the marginal edges of an opening in an article such as a bag to which the slide fastener is attached. It has thus been desired to use physicochemically similar or compatible materials for slide fastener tapes and for at least portions of an article to which the slide fastener is attached. Heretofore, rows of coupling elements were secured to the support tapes by means of sewn seams consisting of multifilamentary threads as such multifilament would yield itself to the contour of the coupling element and thus give rise to positional stability of the coupling element. It was however necessary subsequently to heat-set a finished slide fastener chain in order to cause this chain to become thermally contracted thereby stabilizing the attachment of the coupling elements to the support tapes.

It has been found that during heat-setting of the fastener chain, the multifilament, threads 7 undergo considerable deformation as shown in FIGS. 5 and 6; that is, the multifilament threads 7 having substantially round cross-section (FIG. 5) prior to application of heat become flattened (FIG. 6) after heat-set, with sharp edges extending transversely across the support tape 8 and forcing the perforated seam 9 of the tape 8 to deform in conformity with such sharp edges of the multifilament threads 7. When transverse pull is applied to such slide fastener, the web of the tape 8 tends to become ruptured at and along the perforated seam 9 that has been deformed, loosening up the connection between the multifilament threads and the coupling elements (not shown) and finally rendering the fastener useless.

SUMMARY OF THE INVENTION

It is therefore an object of the present invention to overcome the foregoing drawbacks of the prior art slide fasteners.

A more specific object of the present invention is to provide an improved slide fastener having a support tape made of a thread-free material such as plastics and non-woven webs, which fastener can retain, after heat-set treatment, sufficient mechanical strength at the connection between sewing stitches and a row of coupling elements secured thereby to the support tape.

According to the invention, a series of sewing stitches used to secure a row of coupling elements to a fastener support tape is formed of at least one thread having a plurality of loops passing through the support tape, the thread being made of a monofilamentary material which is free from thermal deformation.

The invention will be better understood from the following description taken in conjunction with a preferred embodiment shown in the accompanying drawings.

DETAILED DESCRIPTION

Figure 1:
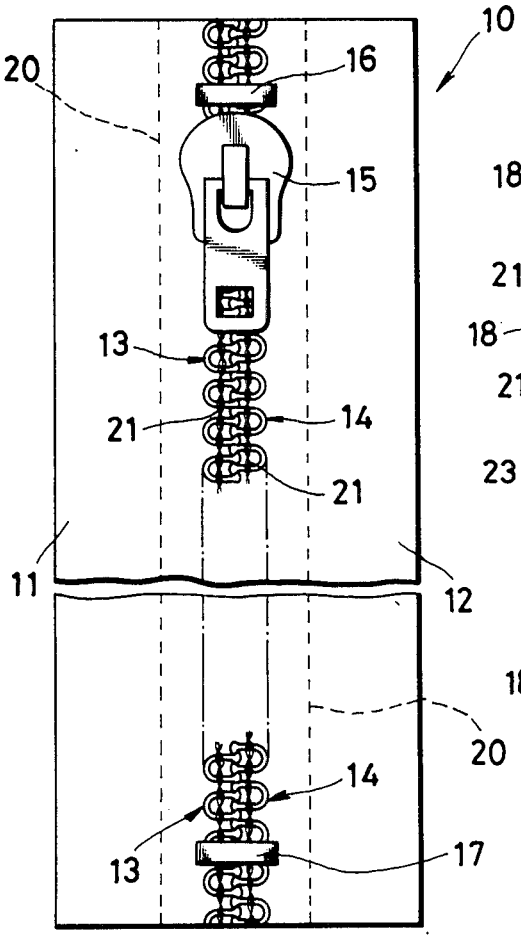
FIG. 1 is a fragmentary plan view of a slide fastener provided in accordance with the present invention.

Referring now to the drawings and FIG. 1 in particular, there is shown a slide fastener 10 which comprises a pair of support tapes 11, 12, a pair of opposed rows of coupling elements 13, 14 secured to and along the longitudinal edges of the respective tapes 11, 12, and a slider 15 reciprocable between two remotely disposed end stops 16, 17 to take the rows of elements 13, 14 into and out of engagement with each other as is well known in the art.

The support tape 11, (12) may be made of a film of plastics material, a non-woven fabric or a web of other materials which are free of yarns woven or knitted. In the illustrated embodiment, the tape is formed from a plastics film.

Figure 3:
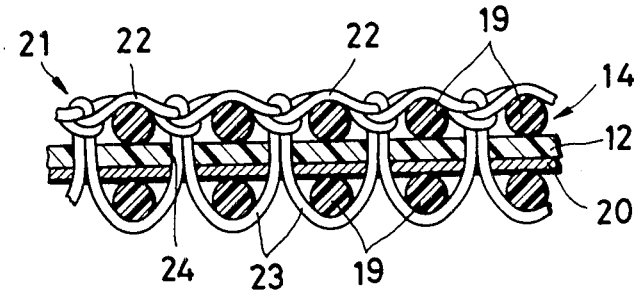
FIG. 3 is a cross-sectional view takes along the line III—III of FIG. 2.

The rows of coupling elements 13, 14 are of a continuous meander or zig-zag formation and each of the coupling elements has a coupling head portion 18 and a pair of upper and lower leg portions 19 extending from the coupling head portion 18 a common direction and mounted astride the longitudinal edge of the tape as better shown in FIG. 3.

Figure 2:
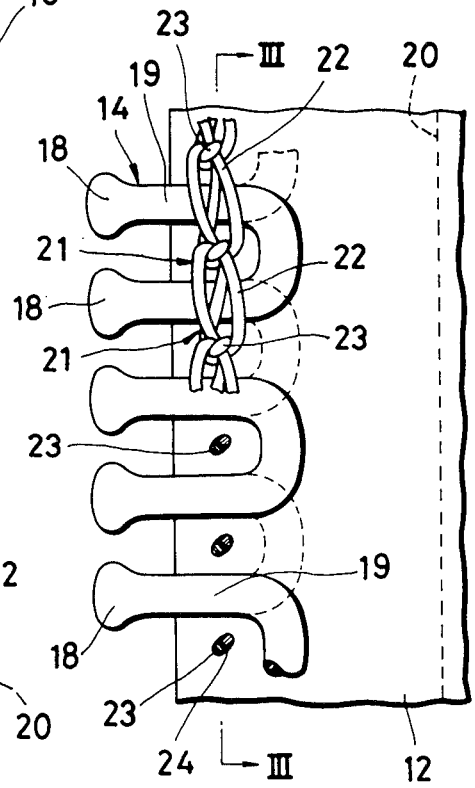
FIG. 2 is a plan view on enlarged scale of a portion of the slide fastener of FIG. 1.

To increase positional stability of the coupling element 13, 14 on the support tapes 11, 12, there is used an elongate reinforcing strip 20 such as of taffeta which underlies the longitudinal edge of each tape as indicated by dotted line in FIGS. 1 and 2 and as better shown in FIG. 3. Instead of using such reinforcing strip 20, the longitudinal edge portion of the tape 11, (12) may be folded to strengthen this tape portion for mounting the coupling elements 13, (14).

Each of the rows of coupling elements 13, 14 is secured to a corresponding one of the support tapes 11, 12 by means of a series of double locked stitches 21 which are formed of two threads, i.e. a looper or locking thread 22 and a needle thread 23. The looper thread 22 overlies the upper legs 19 of the row of coupling elements 13 (14), while the needle thread 23 overlies the lower legs 19 of the coupling elements 13 (14). The needle thread 23, as shown in FIG. 3, has a plurality of loops passing through respective perforations 24 in the tape 11, (12) and interlaced with the looper thread 22 in a manner well known in the art.

In the illustrated embodiment, the looper thread 22 is made of a multifilamentary material and the needle thread 23 of a monofilamentary material. Both threads 22, 23 however may be monofilamentary for the purpose of the invention. Importantly, the particular thread; i.e. needle thread 23, which passes through the web of the tape 11, (12) should be monofilamentary in order to ensure freedom of deformation when the slide fastener 10 is subjected to heat-set treatment.

Figure 4:
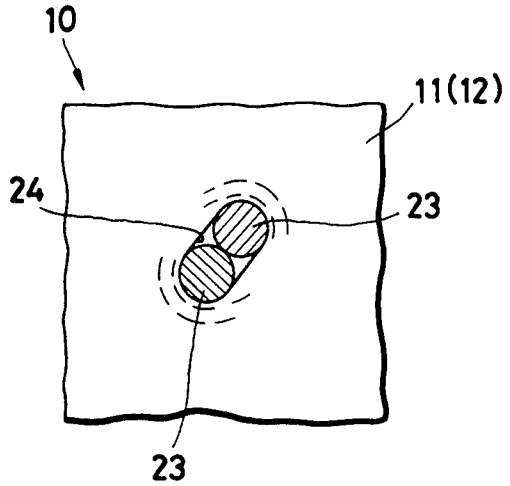
FIG. 4 is a cross-sectional view on enlarged scale of the sewing threads accommodated in the seam aperture after the fastener has undergone heat-set treatment.
Figure 5:
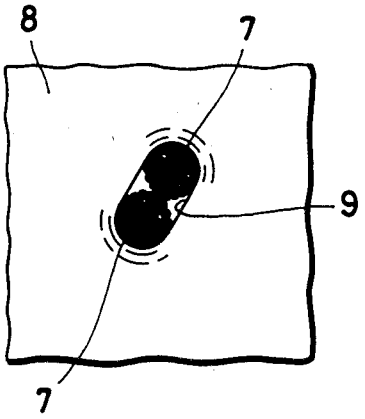
FIG. 5 (PRIOR ART)
FIG. 5 is a view similar to FIG. 4 but showing the conventional multifilamentary sewing threads prior to heat-set.
Figure 6:
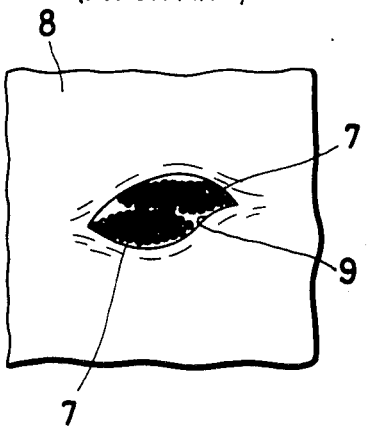
FIG. 6 (PRIOR ART)
FIG. 6 is a view showing the conventional sewing threads deformed after heat-set.

It has now been found that two adjacent portions of the needle thread 23 retain substantially original form and posture with round cross-section even after the finished slide fastener 10 has undergone thermal treatment as illustrated in FIG. 4. The perforation 24 through which the two adjacent portions of the needle thread 23 pass likewise remains unchanged and conforming peripherally with such portions and is therefore free from rupture which would otherwise occur when lateral pull is exerted to the fastener 10. With the needle threads 23 and the perforations 24 thus held substantially undeformed after heat-set treatment of the fastener 10, the coupling elements 13, 14 can be maintained stably in proper position with respect to the respective support tapes 11, 12.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slide fastener comprising:

(a) a pair of support tapes of uniform transverse cross-section each carrying on its one longitudinal edge a row of coupling elements, each said support tape having a series of perforations extending along said row of coupling elements and being made of one of a film of plastics material, a non-woven fabric and a thread-free web;

(b) a series of sewing stitches securing said row of coupling elements to each support tape, said sewing stitches comprising double locked stitches formed of a looper thread of a multifilamentary material and a monofilamentary needle thread having a plurality of loops passing through corresponding ones of said performations in said support tape and interlaced with said looper thread, and (c) each of said loops of said needle thread having two adjacent thread portions received in one of said perforations and having a substantially thermally undeformable circular cross-section, each of said perforations having a substantially thermally undeformable oblong shape and conforming peripherally with said two adjacent portions of each said loop.

2. A slide fastener according to claim 1, said coupling elements being of the zig-zag type having legs straddling said edge.

3. A slide fastener comprising:

(a) A pair of support tapes of uniform transverse cross-section each carrying on its one longitudinal edge a row of coupling elements, each coupling element having a pair of legs staddling said edge, each said support tape being made of one of a film of plastics material, a non-woven fabric, and a thread-free web; and (b) a series of sewing stitches securing said row of coupling elements to each support tape, said sewing stitches being formed of at least one monofilamentary thread having a plurality of loops passing through said support tape, said sewing stitches comprising double-locked stitches formed of a loop or thread overlying and directly engaging one leg of each coupling element and a monofilamentary needle thread having a plurality of loops passing through said support tape and interlaced with said loop or threads, and overlying and directly engaging the other leg of each coupling element.

* * * * *